United States Patent [19]

Liebrandt

[11] Patent Number: 4,793,158

[45] Date of Patent: Dec. 27, 1988

[54] PROCESS AND MECHANISM FOR FEEDING WEFT THREADS FOR WARP KNITTING MACHINES WITH LONGITUDINAL CONVEYORS AND RAKES

[75] Inventor: Gunnar Liebrandt, Hof/Saale, Fed. Rep. of Germany

[73] Assignee: LIBA Maschinenfabrik GmbH, Fed. Rep. of Germany

[21] Appl. No.: 127,132

[22] Filed: Dec. 1, 1987

[30] Foreign Application Priority Data

Dec. 5, 1986 [DE] Fed. Rep. of Germany ..... 3641640

[51] Int. Cl.[4] ..... D04B 23/06

[52] U.S. Cl. ..... 66/84 A

[58] Field of Search ..... 66/84 A, 85 A

[56] References Cited

U.S. PATENT DOCUMENTS

| | | | |
|---|---|---|---|
| 3,564,872 | 2/1971 | Klaeui | 66/85 A |
| 3,756,043 | 9/1973 | Kemter | 66/84 A |
| 4,677,831 | 7/1987 | Wunner | 66/84 A |
| 4,706,475 | 11/1987 | Wunner | 66/84 A |

FOREIGN PATENT DOCUMENTS

| | | |
|---|---|---|
| 2129866 | 6/1970 | Fed. Rep. of Germany . |
| 1308952 | 3/1973 | United Kingdom . |
| 1457639 | 12/1976 | United Kingdom . |

*Primary Examiner*—Ronald Feldbaum

*Attorney, Agent, or Firm*—Bell, Seltzer, Park & Gibson

[57] ABSTRACT

A process and apparatus is disclosed for feeding weft threads to a warp knitting machine including longitudinal conveyors traveling towards the knitting instrumentalities. Weft thread rakes are arranged outside of the longitudinal conveyors and are movable between a starting position in which the weft threads are placed into the longitudinal conveyors and the rakes, and a racking position against the traveling direction of movement of the longitudinal conveyors. After reaching the racking position, the weft threads are transferred onto the longitudinal conveyors and the rakes are then returned to the starting position in the direction of travel of the longitudinal conveyors. The move of the rakes from the racking position to the starting position is effected by a temporary coupling connection of the rakes with the longitudinal conveyors. After transfer of the weft threads, this coupling connection is cancelled as the rakes reach the starting position.

6 Claims, 3 Drawing Sheets

PROCESS AND MECHANISM FOR FEEDING WEFT THREADS FOR WARP KNITTING MACHINES WITH LONGITUDINAL CONVEYORS AND RAKES

FIELD OF THE INVENTION

This invention relates generally to a process and apparatus for feeding weft inlay threads to a warp knitting machine in which the weft threads are initially fed to rakes positioned adjacent the longitudinal weft thread conveyors and with the rakes being movable between a starting position and a racking position with the weft threads being transferred from the rakes onto the longitudinal conveyors when the rakes are in the racking position, and more particularly to such a process and apparatus in which the rakes are temporarily coupled to the longitudinal conveyors to move the rakes from the racking position to the starting position.

BACKGROUND OF THE INVENTION

It is generally known to utilize longitudinal conveyors and rakes for feeding weft inlay threads to the knitting instrumentalities of a warp knitting machine in parallel relationship and at a consistent distance relative to each other, as disclosed in U.S. Pat. No. 3,564,872. A weft carriage feeds an array of weft threads with each transverse movement across the machine so that individual consecutive arrays consist of equally spaced weft threads. The desired equal distance between all threads is obtained by the rake taking over the array of weft threads at the end of each transversal movement of the weft carriage outside of the longitudinal conveyors by imparting a racking movement to the rake in the opposite direction of the direction of travel of the longitudinal conveyors at the end of each transversal movement of the weft carriage. The array of weft threads is transferred from the rake to the longitudinal conveyor when the rake moves to the racking position. The movement of the weft carriage and the rack is coordinated with the movement of the longitudinal conveyor so that the stroke and speed of movement of the rake accurately matches the corresponding movement of the longitudinal conveyor. In the aforesaid U.S. patent this coordination of movement is accomplished with the aid of a cam which rotates in synchronism with the continuously running longitudinal conveyor.

This type of timing cam is expensive to manufacture. Also, the timing cam must be changed when the width of the array of weft threads is altered. In particular situations where several weft carriers are used, as disclosed in DE-OS No. 3 343 048, the timing cam must have its own drive. In these instances where two cams are required for each weft carriage, each timing cam must be provided with its own drive so that this arrangement necessitates a very expensive construction.

SUMMARY OF THE INVENTION

It is an object of the present invention to simplify the drive of the rake by temporarily coupling the rake to the respective longitudinal conveyor so that the rake and the longitudinal conveyor can be easily adapted to varying widths of arrays of weft threads, and so that a high degree of accuracy is assured in regard to the synchronous movement of the rake and the longitudinal conveyor.

In accordance with the present invention, the movement of the rake from the racking position to the starting position is carried out by temporarily drivingly connecting the rake with the longitudinal conveyor and then breaking or disconnecting this temporary coupling upon movement of the rake back to the starting position.

By coupling the rake to the respective longitudinal conveyor, the movement of the rake and the longitudinal conveyor will be synchronous as long as this coupling connection is maintained. Since the position of the rake and the longitudinal conveyor does not change relative to each other, it is possible to transfer one array of weft threads from the rake to the longitudinal conveyor at any time during this movement. Under these circumstances, it is possible to perform this transfer at a time at which the weft yarn guide carriage is on its way to the other associated longitudinal conveyor. In this position of the weft carriage, the weft threads which it is laying extend relatively flat across the area between the two longitudinal conveyors which substantially simplifies the transfer. This transfer essentially consists in the weft threads gliding off of the teeth of the rack at an angle depending upon the angle of the weft threads so that the thus moved weft threads are captured by the respective hooks of the longitudinal conveyor.

This gliding off and capturing of the weft threads does not take place at an accurately definable point in time since it is dependent upon thread tension, current thread friction, and, of course, possible minor inaccuracies in the position of the teeth of the rake. Because of these variables, the gliding off of individual warp threads of an array of threads will not take place at exactly the same time but occurs during the period of time in which the weft carriage is moving across the area between the two longitudinal conveyors. For this reason, it is especially important to maintain accurate synchronization between the movement of the rake and the longitudinal conveyor and, in the present instance, is achieved by the temporary coupled driving connection between the rake and the longitudinal conveyor so that the teeth of the rake and the hooks of the longitudinal conveyor remain in the same position relative to each other to insure that the individual weft threads which glide off of the teeth of the rake are accurately positioned on the hooks of the longitudinal conveyor.

Adoption to different widths of the arrays of weft threads poses no problem when the rake is coupled to the respective longitudinal conveyor in accordance with the present invention. From the starting position, in which the weft threads are placed both into the longitudinal conveyor and into the rake by the weft carriage, the rake is moved into the racking position, which may be effected in the known manner by one quick step by means of random mechanical means. Thus, the racking position may be defined by an adjustable mechanical stop or an adjustable proximity switch or stroke limiter. The driving coupling between the rake and the respective longitudinal conveyor is achieved at this racking position when the stop or the proximity switch is reached so that the rake then moves in synchronism with the longitudinal conveyor. This optional setting of the racking position permits the mechanism to be adapted to the currently required width of the array of threads.

The mechanism for performing the process according to the present invention is conveniently provided by a coupling link on the rake which engages the respective longitudinal conveyor and may be coupled or uncoupled, depending upon the position of the rake. The arrangement of the coupling link of the rake facilitates compact construction, and because of the proximity of the rake and the longitudinal conveyor, engagement of the coupling link to the longitudinal conveyor is accomplished by a very short route.

In the illustrated embodiment of the invention, the coupling link includes a sprocket wheel having its teeth in driving engagement with the longitudinal conveyor and the sprocket wheel is selectively rotatable on or lockable to a shaft attached to the rake. Thus, drivingly engaging the rake to the longitudinal conveyor is accomplished by mean of the sprocket wheel acting as a coupling link. When the sprocket wheel is supported for rotation on the shaft, the rake and the longitudinal conveyor are not drivingly coupled to each other because the sprocket wheel is free to idle along the longitudinal moving conveyor. When, however, the sprocket wheel is locked on the shaft and coupled to the rake, the longitudinally moving conveyor moves the nonrotatable sprocket wheel and thus the rake.

The coupling link for permitting the sprocket wheel to rotate on or be lockingly engaged with the shaft attached to the rake comprises a magnetic clutch between the sprocket wheel and the fixed or nonrotating shaft. A magnetic clutch has the advantage of being controllable in a simple and effective manner so that the driving connection between the rake and the longitudinal conveyor is easily controlled in a simple manner.

The engagement and disengagement of the coupling link may be controlled by providing a stop for the starting position of the rake and an adjustable stroke limiter for the racking position of the rake. With this arrangement, the racking movement is completed when the stroke limiter is reached and the racking movement is completed, thereby establishing the coupling link between the longitudinal conveyor and the rake. A limit switch is provided on the stop which cancels or disengages the coupling connection when the rake engages the stop, at the starting position.

Disengagement of the coupling link at the end of the racking movement of the rake is conveniently effected by means of a contact switch. This contact switch is actuated by the weft thread carriage when the weft threads are placed in position thereby.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
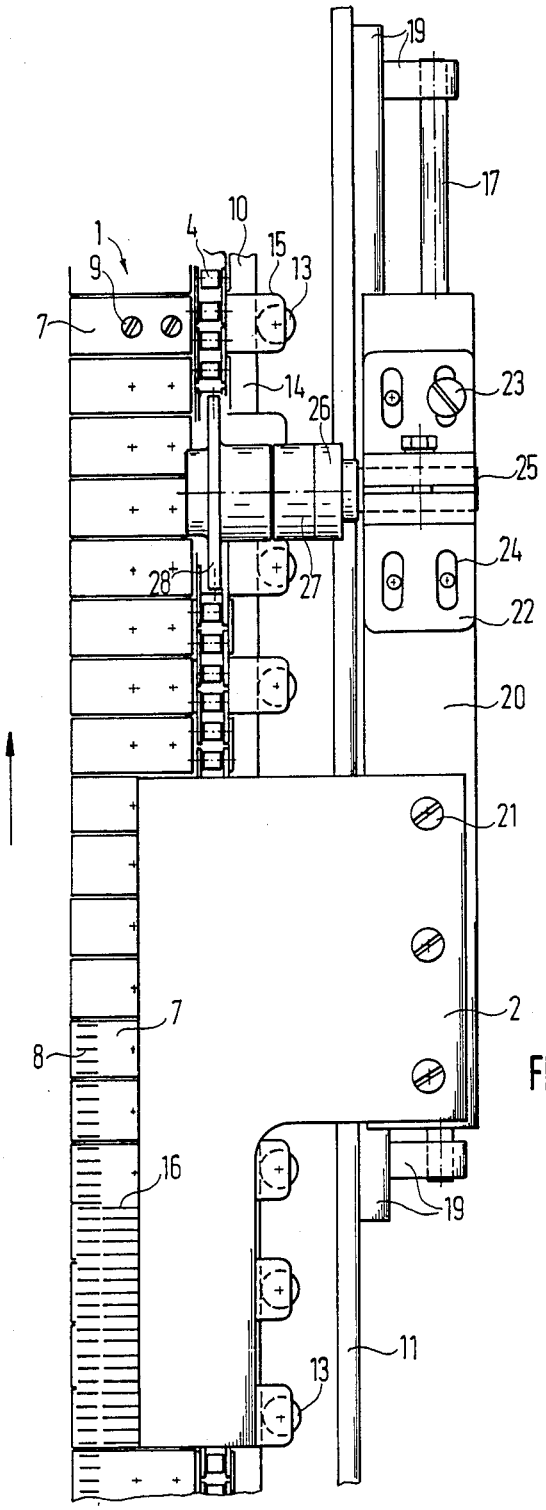
FIG. 1 is a fragmentary plan view of a longitudinal conveyor with a rake associated therewith in accordance with the present invention.

FIG. 1 shows the longitudinal conveyor, broadly indicated at 1, and the associated rake 2 supported on one side of the frame of a warp knitting machine. A mirror image of the longitudinal conveyor 1 and the rake 2 is provided on the opposite side of the warp knitting machine, not shown. The weft inlay threads extend across the area between the two longitudinal conveyors in the manner illustrated in the aforesaid U.S. Pat. No. 3,564,872 and the DE-OS No. 3 343 048. The longitudinal conveyor 1 includes a triple roller chain 3 (FIG. 3) provided with rows of chain rollers 4, 5 and 6. Individual hook sockets 7 are attached in succession onto roller chain 3 by screws 9 and carry hooks 8 of the longitudinal conveyor 1. The roller chain 3 is carried and guided by a chain guide track 10 which is secured to a carrier frame member 12. In order to accommodate tee tension exerted upon the hooks 8 by the weft threads, the roller chain 3 is provided with support rollers 13 which roll against the side face 14 of the roller chain guide track 10. The support rollers 13 are supported and connected to the chain 3 by angle brackets 15. The roller chain 3 is driven by the main drive of the warp knitting machine in a conventional manner.

The rake 2 is supported for longitudinal forward and rearward movement adjacent to the longitudinal conveyor 1 and includes outwardly extending rake teeth 16 positioned opposite the hooks 8 of the longitudinal conveyor 1. The rake 2 is supported for movement on and along upper and lower guide rods 17 fixed at their opposite ends to the machine frame 11 by means of spaced-apart bearing blocks 19.

Figure 3:
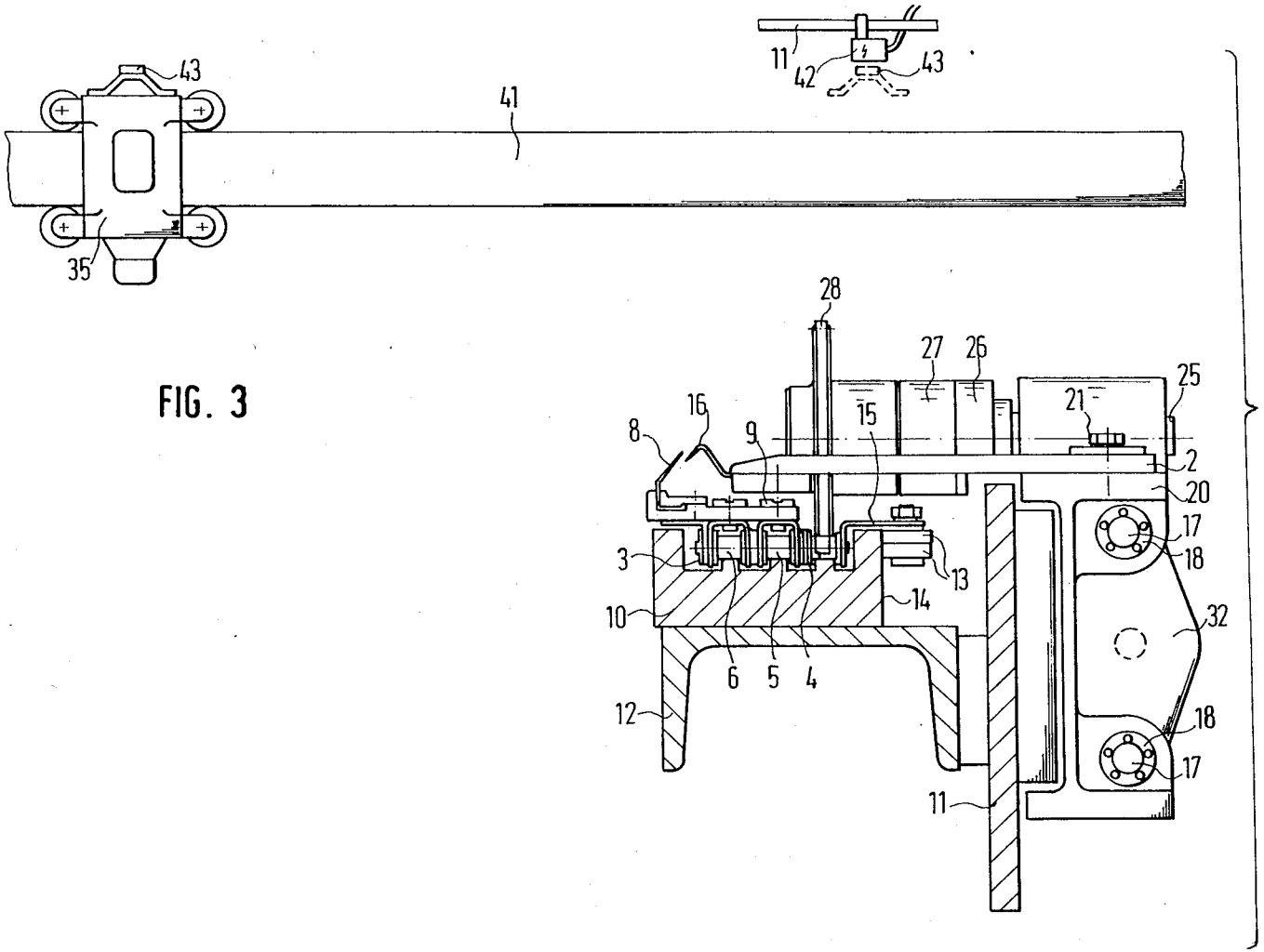
FIG. 3 is an enlarged vertical sectional view through the longitudinal conveyor of FIG. 1 and illustrating the weft thread carriage associated therewith.

The rake 2 is fixed on a carrier bracket 20 by means of screws 21 and the carrier bracket 20 is supported for longitudinal movement along the guide rods 17 by bearings 18 (FIG. 3). A bearing block 22 is supported on the upper surface of the carrier block 20 by screws 23 which extend through elongated holes or slots 24 to facilitate longitudinal adjustability of the bearing block 22 along the carrier block 20. One end of a stub shaft 25 is clamped in the bearing block 22 and is, therefore, nonrotatable in relation to the bearing block 22, in the embodiment shown. A magnetic clutch 26 and associated coupling collar 27 are supported on the stub shaft 25 and are connected to the sprocket wheel 28 mounted on the stub shaft 25. The sprocket wheel 28 is freely rotatable on the stub shaft 25 when the magnetic clutch 26 is not energized. When the magnetic clutch 26 is energized, the magnetic clutch 26 prevents rotation of the sprocket wheel 28 on the stub shaft 25.

When the magnetic clutch 26 is not energized, rollers 4 of the roller chain 3 move forwardly and rotate the sprocket wheel 28 without imparting movement to the carrier bracket 20 and rake 2. On the other hand, when the magnetic clutch 26 is energized, the sprocket wheel 28 is maintained in a fixed and nonrotating position so that the rollers 4 of the chain 3 move the rake 2 forwardly in a synchronous manner with the forward movement of the longitudinal conveyor 1.

Figure 2:
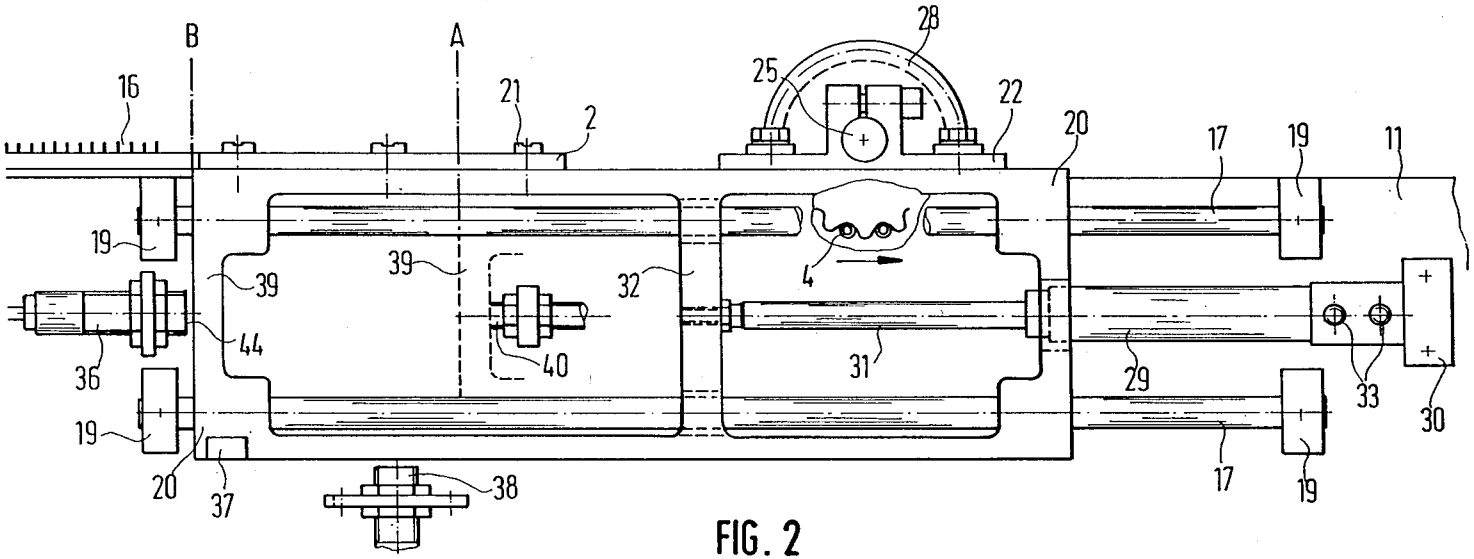
FIG. 2 is a side elevational view of FIG. 1 looking inwardly at the right-hand side thereof.

FIG. 2 illustrates the manner in which the carrier bracket 20 and the rake 2 carried thereby may be moved to and fro relative to the conveyor 1 and the machine frame 11 when the magnetic clutch 26 is not energized so that the sprocket wheel 28 is freely rotatable. For this purpose, an air or oil operated cylinder 29 of a piston cylinder unit is secured to the machine frame 11 by means of a bearing block 30 with the outer free end of a piston rod 31 being fixed to a medial transverse member 32 of the carrier bracket 20. The piston cylinder unit is provided with the usual inlet and outlet openings 33 to accommodate the pressure medium used in operating the piston cylinder unit.

The reciprocal movement of the rake 2, along with the necessary control of the magnetic clutch 26, will now be explained in connection with FIGS. 2 and 3. In FIG. 2, the rake 2 is shown in the solid line racking position indicated by the dash-dot line B, in which position the weft threads held by the teeth 16 on the rake 2 are transferred to the hooks 8 of the longitudinal conveyor 1. In racking position B, the rearward movement of the rake 2 has been stopped by a stroke limiter 36 which is illustrated in the form of a conventional electrical proximity switch having a front face 44 which detects the approach of a transverse rear end member 39 of the carrier bracket 20. The proximity switch 36 operates when the front face 44 of the stroke limiter 36 is at a certain position relative to the corresponding face of the transverse member 39 so that the proximity switch 36 emits a signal which stops the movement of rake 2 in the rearward direction toward the stroke limiter 36, in a manner to be presently described. The signal from the stroke limiter 36 energizes the magnetic clutch 26 so that the sprocket wheel 28 is locked in a nonrotating position on the stub shaft 25. The longitudinal conveyor 1, advancing in the forward direction of the arrow, then moves the bearing block 22, the carrier bracket 20 and the rake 2 supported thereon by means of the nonrotating sprocket wheel 28 at exactly the same speed as that of the longitudinal conveyor 1. While the rake 2 is moving forwardly, the weft threads held by the teeth 16 of the rake 2 are transferred to the hooks 8 of the longitudinal conveyor 1.

A switch operator 37 (FIG. 3) is carried by the carrier bracket 20 and cooperates with a proximity limit switch 38. When the switch operator 37 is moved along opposite the proximity limit switch 38, an electrical signal is emitted to deenergize the magnetic clutch 26. At this time the sprocket wheel 28 is free to rotate on the stub shaft 25, thereby cancelling the coupling link between the longitudinal conveyor 1 and the rake 2 so that forward movement of the rake 2 is discontinued. The signal emitted by limit switch 38 35 simultaneously controls the cylinder 29 so that the piston rod 31 is retracted until the inner face of the transverse end member 39 of the carrier bracket 20 contacts an adjustable stop 40. Stop 40 finally arrests forward motion of the rake 2. In FIG. 2, this forward stopped position of the carrier bracket 20 is illustrated by the dotted line position of the transverse member 39 and this position is denoted as the starting position, represented by the dash-dot line A. From the starting position A, rake 2 is moved rearwardly to the racking position B by means of a signal triggered by a weft thread guide carriage 35 (FIG. 3). The weft thread guide carriage 35 is moved back and forth across the width of the warp knitting machine in a conventional manner along traversing rail 41 (FIG. 3). The conventional back-and-forth movement of the weft carriage 35 is illustrated in detail in the patents referred to heretofore.

The weft carriage 35 is moved to the right along the traversing rail 41 beyond the area of the hooks 8 and teeth 16 so that the weft threads carried by the weft thread carriage 35 extend between the hooks 8 and teeth 16 in a conventional manner. As the weft thread carriage 35 reaches the right-hand end of the stroke, a magnet 43 attached to the weft thread carriage 35 moves into position below a proximity switch 42 attached to the machine frame 11. In FIG. 3, this position of magnet 43 is shown in dotted lines. In this position, the proximity switch 42 emits a signal which triggers the racking movement of the rake 2 by connecting the piston cylinder unit so that the piston rod 31 moves the carrier bracket 20 in a rearward position from the starting position A to the racking position B. This rearward racking movement is relatively short and continues over only a very short period of time, less than a second. When the rear transverse member 39 of the carrier block 20 approaches the face 44 of the stroke limiter 36, movement in the rearward direction is stopped, as heretofore described.

The proximity switches heretofore described, the stroke limiter 36, limit switch 38, stop 40 and proximity switch 42 are supported for adjustment to be locked in the adjusted position by providing either conventional elongated slot arrangements or threads with lock nuts. This adjustment provides that the proximity switch 42 will emit a signal at the exact moment when the hooks 8 and teeth 16 are in alignment with each other so that the magnetic clutch 26 is energized at the proper time. With this arrangement, it is possible to insure that the movement of the longitudinal conveyor 1 and movement of the weft thread carriage 35 are maintained in rigid synchronization with the central machine drive. The axial adjustment of the stroke limiter 36 thus determines the exact length of the racking movement and thereby permits adjustment of the width of the array of weft threads. The adjustability of the limit switch 38 and the stop 40 determines the exact starting position of the rake 2.

The reason for continuing to move the rake 2 by means of the cylinder 29 after reaching the limit switch 38 until it hits the stop 40 is that it is not possible to exactly define the starting position by means of the magnetic clutch 26 discontinuing rotation of the sprocket wheel by means of the limit switch 38. However, a definite starting position is accurately defined when the carriage bracket 20 engages the stop 40. For this reason, rake 2 is moved a relatively short distance by means of the cylinder 29 after the limit switch 38 has disengaged the magnetic clutch 26 so that the rake 2 is then moved to an accurately defined starting position A.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a process for feeding weft threads to a warp knitting machine including longitudinal conveyor means (1) traveling toward the knitting instrumentalities, transversely movable weft carriage means (35) with thread guide means, and rake means (2) arranged outside of said longitudinal conveyor means (1), said rake means (2) being movable between a starting position (A) in which the weft threads are placed into the longitudinal conveyor means (1) and said rake means (2) and a racking position (B) against the traveling direction of said longitudinal conveyor means (1), whereby the weft threads are transferred onto said longitudinal conveyor means (1) upon reaching said racking position (B), and whereby said racking means (2) is returned to said starting position (A) in the traveling direction of said longitudinal conveyor means (1), said process being characterized by the step of temporarily drivingly connecting said rake means (2) with said longitudinal conveyor means (1) to move said rack means (2) from said racking position (B) to said starting position (A), and the step of disconnecting the driving connection of said rack means (2) with said longitudinal conveyor means (1) when said rack means (2) reaches said starting position (A).

2. In an apparatus for feeding weft threads to a warp knitting machine including longitudinal conveyor means (1) traveling toward the knitting instrumentalities, transversely movable weft carriage means (35) with thread guide means, and rake means (2) arranged outside of said longitudinal conveyor means (1) said rake means (2) being movable between a starting position (A) in which the weft threads are placed into the longitudinal conveyor means (1) and said rake means (2) and a racking position (B) against the traveling direction of said longitudinal conveyor means (1), whereby the weft threads are transferred onto said longitudinal conveyor means (1) upon reaching said racking position (B), and whereby said racking means (2) is returned to said starting position (A) in the traveling direction of said longitudinal conveyor means (1), said apparatus being characterized by coupling link means (26, 27 and 28) for temporarily drivingly connecting said rake means (2) with said longitudinal conveyor means (1) to move said rack means (2) from said racking position (B) to said starting position (A), and control means (38, 40) for disconnecting the driving connection of said rack means (2) with said longitudinal conveyor means (1) when said rack means (2) reaches said starting position (A).

3. An apparatus according to claim 2, characterized in that said coupling link means (26, 27, 28) comprises a sprocket wheel (28) engaging said longitudinal conveyor means (1), and wherein said sprocket wheel (28) is optionally rotatably or lockably mounted on a stub shaft (25) attached to said rake means (2).

4. An apparatus according to claim 3, characterized in that said coupling link means (26, 27, 28) comprises a magnetic clutch (26) arranged between said sprocket wheel (28) and said rake means (2).

5. An apparatus according to claims 2, 3 or 4, characterized by a stop (40) for defining said starting position (A) of said rake means (2), and an adjustable stroke limiter (36) for defining the racking position (B) of said rake means (2), and wherein said stroke limiter (36) is operable to establish the coupling connection between said longitudinal conveyor means (1) and said rake means (2) when the racking movement is completed, and wherein a limit switch (38) is provided for cancelling the coupling connection when said rake means (2) approaches said starting position (A).

6. An apparatus according to claims 2, 3, 4 characterized by a contact switch (42) positioned to be tripped by said weft carriage means (35) after placement of the weft threads to initiate the racking movement of said rake means (2).

* * * * *